US009119520B2

(12) United States Patent
Plum et al.

(10) Patent No.: US 9,119,520 B2
(45) Date of Patent: Sep. 1, 2015

(54) DISHWASHER SUMP MEMBER

(75) Inventors: Hans-Dieter Plum, Aachen (DE); Thomas Brinkmann, Bad Aibling (DE)

(73) Assignee: Electrolux Home Products Corporation, N.V., Brussels (BE)

( * ) Notice: Subject to any disclaimer, the term of this patent is extended or adjusted under 35 U.S.C. 154(b) by 778 days.

(21) Appl. No.: 13/259,673

(22) PCT Filed: Mar. 23, 2010

(86) PCT No.: PCT/EP2010/001809

§ 371 (c)(1), (2), (4) Date: Sep. 23, 2011

(87) PCT Pub. No.: WO2010/108653

PCT Pub. Date: Sep. 30, 2010

(65) Prior Publication Data

US 2012/0031442 A1 Feb. 9, 2012

(30) Foreign Application Priority Data

Mar. 27, 2009 (EP) ..... 09004440

(51) Int. Cl.
*A47L 15/42* (2006.01)

(52) U.S. Cl.
CPC ..... *A47L 15/4246* (2013.01); *A47L 15/4214* (2013.01); *A47L 15/4229* (2013.01)

(58) Field of Classification Search
CPC ..... A47L 15/4229; A47L 15/4231; A47L 15/4246; A47L 15/4214
USPC ..... 134/109
See application file for complete search history.

(56) References Cited

U.S. PATENT DOCUMENTS

| | | | |
|---|---|---|---|
| 4,146,405 | A | 3/1979 | Timmer et al. |
| 2003/0006305 | A1 | 1/2003 | Hegeman |
| 2004/0103930 | A1 | 6/2004 | Lee |
| 2006/0042657 | A1 | 3/2006 | Welch |
| 2006/0060228 | A1 | 3/2006 | Yoon et al. |

(Continued)

FOREIGN PATENT DOCUMENTS

| | | | |
|---|---|---|---|
| DE | 41 42 697 | A1 | 7/1993 |
| DE | 42 14 147 | A1 | 11/1993 |

(Continued)

OTHER PUBLICATIONS

International Search Report for International Application No. PCT/EP2010/001809, filed Mar. 23, 2010.

(Continued)

*Primary Examiner* — Michael Barr
*Assistant Examiner* — Spencer Bell
(74) *Attorney, Agent, or Firm* — Alston & Bird LLP

(57) ABSTRACT

A dishwasher comprises a wash chamber and a water-collecting sump member which is fastened to an opening in a lower end portion of the wash chamber by means of a water-tight connection, wherein the sump member is made at least in part of plastics material and comprises at least one water inlet or outlet opening that is formed as an integral part of the sump member. The dishwasher comprises a water softening device and the sump member comprises a water inlet and an integrated first passage which is formed at least in part of plastics material as an integrally formed part of the sump member for passing water from the water inlet to the water softening device.

19 Claims, 4 Drawing Sheets

(56) References Cited

U.S. PATENT DOCUMENTS

| | | | | |
|---|---|---|---|---|
| 2006/0174916 | A1 | 8/2006 | Hedstrom | |
| 2008/0248075 | A1* | 10/2008 | Brambilla et al. | 424/411 |
| 2012/0017952 | A1 | 1/2012 | Plum et al. | |

FOREIGN PATENT DOCUMENTS

| | | | |
|---|---|---|---|
| DE | 10 2005 044622 | A1 | 4/2006 |
| EP | 0 556 776 | A1 | 8/1993 |
| EP | 0 855 164 | A | 7/1998 |
| EP | 1 023 869 | A2 | 8/2000 |
| EP | 2 033 566 | A1 | 3/2009 |
| GB | 1 511 799 | A | 5/1978 |
| GB | 2 144 322 | A | 3/1985 |
| WO | WO 2004/096005 | A | 11/2004 |

OTHER PUBLICATIONS

International Search Report and Written Opinion from International Application No. PCT/EP2010/001810, dated Mar. 23, 2010.
Written Opinion from International Application No. PCT/EP2010/001809, dated Mar. 23, 2010.
Extended European Search Report from Application No. 09004439, dated Sep. 15, 2009.
Partial European Search Report from Application No. 09004440, dated Aug. 27, 2009.
Extended European Search Report from Application No. 09004440, dated Oct. 20, 2009.
Extended European Search Report from Application No. 12192994, dated Feb. 7, 2013.
Communication from European Patent Application No. 12192994, dated Dec. 6, 2013.

* cited by examiner

DISHWASHER SUMP MEMBER

CROSS REFERENCE TO RELATED APPLICATIONS

This application is a national stage application filed under 35 U.S.C. 371 of International Application No. PCT/EP2010/001809, filed Mar. 23, 2010, which claims priority from European Application No. 09004440.5, filed Mar. 27, 2009, each of which is incorporated herein in its entirety.

The present invention relates to a dishwasher comprising a wash chamber and a water-collecting sump member which is fastened to an opening in a lower end portion of the wash chamber by means of a water-tight connection, wherein the sump member is made at least in part of plastics material and comprises at least one water inlet or outlet opening that is formed as an integral part of the sump member.

In modern dishwashers attempts have been made to reduce the number of parts that are to be assembled during manufacturing of the dishwasher. Thus, it was suggested to provide a dishwasher with a sump member that is made at least in part of plastics material and which comprises a water inlet opening that is formed as an integral part of the sump member.

In particular, in US-A-20060174916 there is disclosed a dishwasher having a washing tub, wherein a plurality of fluid conduits are formed along the bottom wall of the washing tub or are detachably secured to the bottom wall of the washing tub. Each of the fluid conduits is connected to a water inlet or outlet opening of the sump member.

Furthermore, in DE-A-10 2005 044 622 there is disclosed a dishwasher having a sump member which comprises a water-collecting receptacle and a drain pump for withdrawing water from the water-collecting receptacle, wherein the sump member forms part of the housing of the drain pump.

It is an object of the present invention to provide for a dishwasher, which provides for a higher integrity of its components and which thus further facilitates assembly of the dishwasher.

In a dishwasher comprising a wash chamber and a water-collecting sump member which is fastened to an opening in a lower end portion of the wash chamber by means of a water-tight connection, wherein the sump member is made at least in part of plastics material and comprises at least one water inlet or outlet opening that is formed as an integral part of the sump member, this object is solved in accordance with a first aspect of the present invention in that the dishwasher comprises a water softening device and the sump member comprises a water inlet and an integrated first passage that is formed at least in part of plastics material as an integrally formed part of the sump member for passing water from the water inlet to the water softening device.

By integrating the passage via which water can be passed from the water inlet to the water softening device into the sump member, not only the integrity of the assembly is improved, i.e. less components have to be manufactured and assembled, but also the product safety is improved, because less fittings, sealings and the like are required to connect the water inlet to the water softening device.

The dishwasher of the present invention can be any type of dishwasher, i.e. commercial or domestic dishwasher, but preferably is a dishwasher for domestic use.

The sump member is made at least in part, and preferably is made entirely, of plastics material, which plastics material may be a single material or a mixture of two or more materials. In this manner the sump member can be manufactured by injection molding, which is particularly preferred due to its ability to produce, in a single manufacturing operation, also complex components.

While the sump member and any integrated passages thus can be manufactured as a single integral part, it should be understood that due to the selected geometry of the sump member it may be necessary or at least recommendable to manufacture parts of the sump member as separate members which in a further manufacturing step are releasably or permanently connected to the sump member.

Preferably the sump comprises a plurality of integrated passages which may be provided for connecting various hydraulic components of the dishwasher, such as the water softening device, a salt tank for storing a salt solution for the regeneration of the water softening device, a water distribution system including a circulation pump for passing cleaning liquid to spray nozzles within the wash chamber, a drain pump for draining the sump to a waste water outlet, a mains inlet tube for feeding fresh water into the dishwasher, filter elements for filtering dirt particles from the cleaning liquid circulated within the dishwasher, a water-collecting space of the sump, etc. The integrated passages may extend into and in part within the respective hydraulic component or they may extend to or from an inlet or outlet opening of the respective hydraulic component. Furthermore, any of the integrated passages can be equipped with a backflow protection device, so as to ensure that liquid flowing through the integrated passage only can flow in a certain predetermined direction.

Preferred embodiments of the dishwasher made in accordance with the first aspect of the present invention are defined in the dependent claims.

Preferably, the water softening device comprises an ion exchange material tank for accommodating an ion exchange material, such as a softener resin. In this case, the integrated first passage extends from the water inlet, which preferably is connected to the mains inlet tube of the dishwasher, to an inlet of the ion exchange material tank.

The ion exchange material tank can be formed at least in part of plastics material as an integrally formed part of the sump member. In this manner integrity of the assembly can be further improved.

Preferably, the water softening device comprises a salt tank for storing a salt solution for the regeneration of the ion exchange material, and the sump member comprises an integrated second passage that receives water from a mains inlet tube and leads it into the salt tank. In such an embodiment of the present invention the integrated second passage of the sump member preferably is connected to the mains inlet tube of the dishwasher, i.e. is fed with fresh water that comes directly from the water inlet of the dishwasher, such as a tap to which the dishwasher is connected. In alternative, the integrated second passage can receive mains water from a regeneration dosing device which is provided in the dishwasher, which regeneration dosing device can comprises a separate water storage tank for regeneration water, which storage tank receives water from the mains inlet tube and is connected to the integrated second passage.

If a regeneration dosing device is employed, it preferably is connected to the mains inlet tube via a back-flow safety device, such as an air brake, wherein the regeneration dosing device is provided in its upper portion with a water inlet tube having an arched section that is located at a higher level than the water within the regeneration dosing device, so that water which is provided under pressure from the mains inlet tube can enter the regeneration dosing device, but water from the regeneration dosing device cannot flow back into the mains inlet tube.

In a preferred embodiment of the invention the salt tank is formed at least in part of plastics material as an integrally formed part of the sump member, so as to further improve the integrity of the assembly.

If the dishwasher comprises an ion exchange material tank, the sump member may comprise an integrated third passage for passing water from the ion exchange material tank into the wash chamber or into a water collecting space of the sump member. Thus, the integrated third passage of the sump member can extend from an outlet opening for softened water of the ion exchange material tank to an inlet opening for water of the wash chamber or of the sump member.

If the dishwasher comprises an ion exchange material tank and a salt tank, the sump member preferably comprises an integrated fourth passage for passing salt solution from the salt tank into the ion exchange material tank. Thus, the integrated fourth passage of the sump member can be connected to an outlet opening for salt solution of the salt tank. Preferably, the fourth passage is connected to an inlet opening for salt solution of the ion exchange material tank. In alternative, the fourth passage can be connected to the inlet opening for mains water of the ion exchange material tank. Furthermore, the fourth passage can comprise a backflow protection device.

In a further preferred embodiment of the invention the sump member comprises an integrated fifth passage for passing water from the sump member to a circulation pump of the dishwasher. Thus, the integrated fifth passage of the sump member can extend from an outlet opening of the sump member for circulation water, i.e. for cleaning liquid that is circulated through the wash chamber, to an inlet opening of the circulation pump, i.e. a port of the circulation pump which is arranged on the suction side of such pump.

In preferred embodiments of the invention the sump member comprises an integrated sixth passage for passing water from the circulation pump to spraying nozzles which are provided within the wash chamber. Thus, the integrated sixth passage of the sump member can extend from a circulation water outlet opening of the circulation pump which is located on the pressure side of the circulation pump to an inlet opening of a circulation water distribution system for providing pressurized circulation water to spray arms provided within the wash chamber.

In such embodiments a circulation water distribution system can be provided which comprise a flow control device that is adapted to distribute the supply of pressurized circulation water between at least two spraying nozzles or between at least one spraying device comprising a plurality of spraying nozzles and at least one further spraying nozzle or spraying device, such as an upper and a lower rotating spray arm, which are provided above and below a dishwasher basket, respectively, or which are assigned to individual dishwasher baskets.

In a further preferred embodiment of the present invention the sump member comprises an integrated seventh passage for passing waste water from the sump member to a drain pump of the dishwasher. Thus, the integrated seventh passage of the sump member can extend from an outlet opening of the sump member for waste water which preferably is arranged in a water-collecting bottom region of the sump member, to an inlet opening of the drain pump for waste water which is arranged on the suction side of the drain pump.

Preferably the sump member comprises an integrated eighth passage for passing waste water from the drain pump to a drain tube of the dishwasher. Such integrated eighth passage can extend from an outlet opening of the drain pump for waste water, i.e. a pump port which is arranged on the pressure side of the drain pump, to an inlet opening for waste water of the drain tube. Preferably the eighth passage and/or the drain tube are equipped with a backflow protection device.

The sump member further can comprise an integrated ninth passage which branches off from the first passage upstream of the water softening device for passing at least a portion of the water passing through the first passage into the wash chamber or into the water collecting space of the sump member. With the integrated first passage passing water from the water inlet to the water softening device, the ninth passage thus forms a bypass for passing at least a portion of such water into the wash chamber or into the water collecting space of the sump member, instead of first passing such water through the water softening device. The integrated bypass of the sump member thus can extent from a branch-off opening formed in the integrated first passage to an inlet opening for mains water of the wash chamber or of the water collecting space of the sump member. In order to control the amount of water which is passed to the water softening device and through the bypass, respectively, valve means can be provided in the integrated first passage, in the integrated ninth passage or at the point where the ninth passage branches off from the first passage, which valve means is controllable by a setting device, particularly a setting device which can be set manually and/or by an automatic control device of the dishwasher to take into account local water hardness and/or which is adjusted by the automatic control device according to a water hardness measurement which is performed by a water hardness sensor of the dishwasher, in particular by a conductivity sensor.

In a further preferred embodiment of the present invention the sump member comprises a lower portion comprising a water-collecting receptacle and optionally said ion exchange material tank and/or said salt tank, the sump member further comprising an upper portion which forms a cover member for at least a portion of said water-collecting receptacle, said ion exchange material tank and/or said salt tank.

While thus the water-collecting receptacle of the sump member, the ion exchange material tank and the salt tank can be separately formed parts which in a subsequent manufacturing step are joined together, these components preferably comprise a single integral unit which is formed for example by injection molding of a plastics material. Similarly, also the upper portion which forms a cover for at least a portion of the water-collecting receptacle, a cover for at least a portion of the said ion exchange material tank and/or a cover for at least a portion of the said salt tank, can be separately formed parts which in a subsequent manufacturing step are joined together. Preferably, also the cover components comprise a single integral unit which is formed for example by injection molding of a plastics material.

The portion of the cover member which forms a cover for the salt tank preferably is provided with a salt fill opening through which a regenerating salt for forming a salt solution for the regeneration of the ion exchange material can be filled into the salt tank. The salt fill opening preferably comprises a water-tight closure, in particular a water-tight screw cap.

For ease of manufacturing, the lower portion of the sump member comprising the water-collecting receptacle of the sump member and preferably also the ion exchange material tank and the salt tank on the one hand, and the upper portion of the sump member which comprises individual or combined covers for the respective vessel sections of the lower portion, on the other hand, preferably are separately formed parts which are joined together, preferably in a water-tight manner, either permanently for example by welding, gluing or the like, or releasably for example by a snap-fit connection.

In such embodiments, the cover member preferably is adapted for liquid-tight fixation of the sump member to the opening in the lower end portion of the wash chamber, such as by comprising a sealing which is adapted for water-tight sealing of respective contact areas of the sump cover member and the lower end portion of the wash chamber.

Preferably the opening in the lower end portion of the wash chamber comprises a filter sieve for filtering dirt particles out of the circulation water when it drips off from the articles to be cleaned within the wash chamber and flows down towards the water-collecting receptacle of the sump.

As in conventional dishwashers, the filter sieve preferably comprises a first generally flat but funnel-shaped filter element, as well as a second generally tubular filter element which is arranged vertically within the water-collecting receptacle of the sump. When the sump member is fastened to the opening in the lower end portion of the wash chamber, the sump member cover preferably is arranged below at least an essentially horizontal flat part of the filter sieve. If the filter sieve is made of stainless-steel, the salt fill opening preferably is arranged such that direct contact between the flat filter sieve and an occasional spill of salt solution that may occur during filling of the regenerating salt into the salt fill opening is avoided. In contrast to conventional dishwashers, in which the salt fill opening is provided in the tub bottom aside the flat filter sieve, in the dishwasher suggested herein the salt fill opening preferably located below the flat filter sieve in the cover member of the sump member. With the sump member and thus also the cover member preferably being made of plastics material, the risk of corrosion due to inadvertent spill of salt in the region of the salt fill opening is avoided. For this reason, in the dishwasher suggested herein the tub bottom need not be manufactured from highly corrosion resistant stainless steel, such as austenitic steel, but can also be made of materials comprising less corrosion resistance, such as ferritic stainless steel.

In particular preferred embodiments of the present invention the lower portion and the upper portion of the sump member are formed at least in part of plastics material, and the first, second, third, fourth, fifth, sixth, seventh, eighth and/or ninth passage comprise an integrally formed part of the lower and/or upper portion of the sump member. The integrated passages can comprise channels and/or openings which are provided in the upper and/or lower portion of the sump member. Thus, particularly if the upper portion of the sump member constitutes a cover member for vessel portions of the lower member, such as a water-collecting receptacle of the sump member, an ion exchange material tank or a salt tank, the cover member can comprise integrally formed passages for passing liquid from one section of the cover member to another section of the cover member, where an opening is provided within the cover member, so as to allow any liquid flowing through the passage to pass through the opining and into the respective section of the lower portion of the sump member. Furthermore, when the lower portion of the sump member is designed to constitute vessel sections through which liquid is to be passed, such as an ion exchange material tank which is to be filled with a water softening material, such as a softener resin, through which the water to be passed to the spraying nozzles is fed, or a salt tank which is to be filled with a regeneration salt and through which water is fed so as to prepare a salt solution for regeneration of the ion exchange material, the integrated passages can comprise essentially vertically oriented channels having an inlet or outlet opening which opens close to the bottom of the respective vessel section in which the passage is provided. When the integrated passage comprises an essentially vertically oriented channel, this channel can be an integrally formed part of an essentially vertical side wall of the respective vessel section. Furthermore, the inlet and/or outlet openings of the integrated passages can be provided with a sieve structure to retain particles such as ion exchange material or salt particles in specific sections of the sump member.

Preferably the upper portion of the cover member comprises a generally flat sandwich-type structure comprising an upper sandwich component and a lower sandwich component which enclose an intermediate space therebetween forming at least part of said first, second, third, fourth, sixth, eighth and/or ninth passage. The upper and the lower sandwich components thus can be arranged essentially horizontally and above each other, wherein the intermediate space between the upper and the lower sandwich components can comprise a plurality of essentially vertical wall sections. Any of the integrated passages of the sump member thus can be defined by two neighboring essentially vertical wall sections which are provided either on one or on both the upper sandwich component and lower sandwich component. In order to provide for a fluid tight connection between the upper and the lower sandwich components particularly in those areas where integrated passages are provided, the upper and lower sandwich components can be connected to each other by gluing or welding.

The integrity of the sump member can be even further increased when the sump member forms at least part of a housing of a circulation pump of the dishwasher and/or at least part of a housing of a drain pump of the dishwasher. If the sump member comprises part of a housing for the drain pump or the circulation pump, the integrated passages for hydraulic connection of these pumps can be integrated at least in part in the housing.

In further preferred embodiments of the present invention the sump member comprises at least one integrated fixation element for fixation of an electronic or electromechanical device to the sump member, wherein the fixation element is formed at least in part of a plastics material as an integral part of the sump member. Such a fixation element can be adapted for example for fixation of a flow control device such as valves, pressure switches and the like, a water heating device, in particular for heating the circulation water, of the circulation pump, of the drain pump, and/or of at least one sensor, e.g. a temperature sensor, a turbidity sensor for the optical turbidity of water, a water hardness sensor, a water pressure sensor, a water conductivity sensor, a water level sensor and the like. In embodiments in which only part of the electronic or electromechanical device is to be arranged in liquid contact with a respective section of the sump member, as applies for example for a turbidity sensor of which a measuring probe is located within a section of the sump member which during operation of the dishwasher at least temporarily is filled with liquid, whereas further parts of the sensor, such as the electrical contacts are to be located outside the liquid filled section, the fixation element preferably comprises a liquid sealing through which the electronic or electromechanical device extends. In embodiments in which fixation elements are provided for attaching a water heating device for heating the circulation water, such fixation elements preferably are provided in the sump member, in particular in the water collecting receptacle of the sump member. Alternatively or additionally; a water heating element could also be fixed by means of respective fixation element inside the housing of the circulation pump, and particularly in the section where the impeller of such pump is located.

Preferably the sump member including any integrated components thereof is made of moldable plastics material such as polypropylene, which is particularly suited for the manufacturing of dishwasher components because it is resistant to alkaline and hot water.

The sump member and particularly its inlet or outlet openings preferably are designed for releasable or permanent snap-fit connection and liquid coupling to further components of the dishwasher such as the mains inlet tube, the drain tube and the like.

In a dishwasher comprising a wash chamber, a water-collecting sump member located below an opening in a lower end portion of the wash chamber, and a water softening device including an ion exchange material tank for accommodating an ion exchange material and a salt tank for storing a salt solution for the regeneration of said ion exchange material, the above mentioned object is solved in accordance with a second aspect of the present invention in that the salt tank comprises a salt fill opening which is located below said opening in the lower end portion of the wash chamber.

Whereas in accordance with the first aspect of the present invention the passage via which water can be passed from the water inlet to the water softening device is integrated into the sump member, in accordance with the second aspect of the present invention the integrity of the assembly is improved by locating the salt fill opening in the region of the opening in the lower end portion of the wash chamber, in which region the sump member is provided, so that on the one hand the fill opening of the salt tank or the salt tank as such can be designed as an integral part of the sump member, and that on the other hand contact between an occasional spill of salt solution, that may occur during filling of regenerating salt into the salt tank, and the bottom of the washing chamber is avoided. By relocating the salt fill opening from a location aside the opening in the bottom of the wash chamber, as it commonly is selected in conventional dishwashers, to a location below the opening in the lower end portion of the wash chamber, the bottom of the washing chamber need not be manufactured from highly corrosion resistant stainless steel, such as austenitic steel, but can be made of materials comprising less corrosion resistance, such as ferritic stainless steel. In this manner the production costs of the dishwasher can be reduced.

In a preferred embodiment of the dishwasher made in accordance with the second aspect of the present invention, a filter sieve is arranged within the opening in the lower end portion of the wash chamber, wherein the salt fill opening is located below said filter sieve. When the salt fill opening is located below the filter sieve, soil particles are prevented from adhering to the salt fill opening.

A preferred embodiment of the present invention is described in further detail below by reference to the accompanying drawings, in which.

Figure 1:
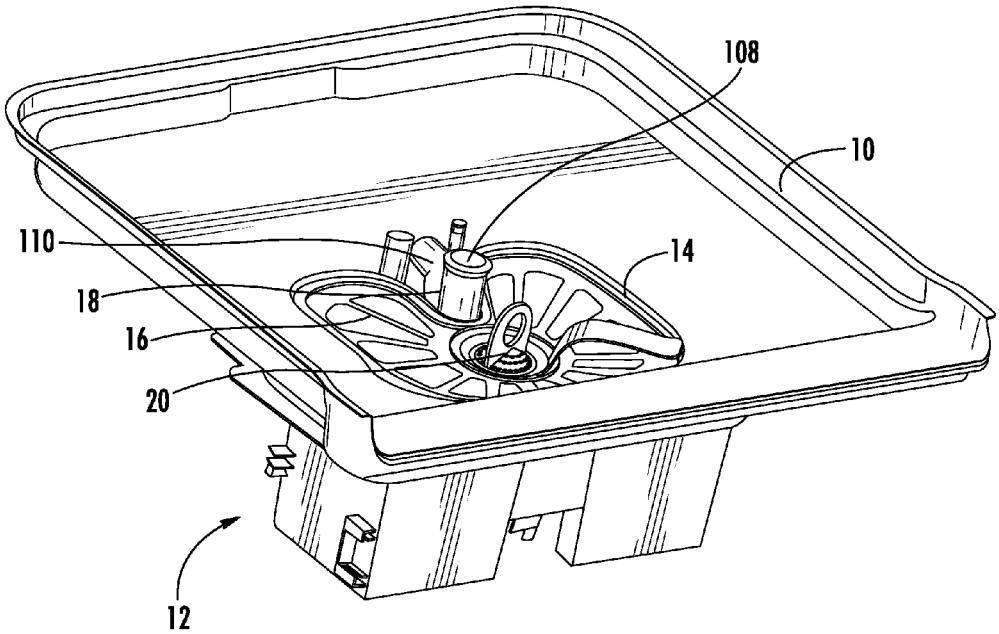
FIG. 1 is a perspective view of a sump member according to the present invention when assembled to a tub bottom of a wash chamber of a dishwasher.

In FIG. 1 there is shown a tub bottom 10 of a dishwasher, which particularly may be a domestic dishwasher which typically has two dishwasher baskets into which articles to be washed can be loaded, wherein rotatable spray arms are provided in the wash chamber of the dish washer so as to spray a cleaning liquid onto the articles to be washed. Tub bottom 10, which may a stainless steel member, is a generally flat but funnel-shaped member having at about its centre an opening 14 below which a sump member, generally designated with 12, is located. Sump member 12 comprises a water collection receptacle as will be further explained below by reference to FIGS. 3 to 6. In order to prevent dirt particles from entering the water collection receptacle of the sump, a generally flat but funnel-shaped filter element 16, which preferably is a stainless steel member, is located within opening 14 of tub bottom 10. Additionally, a generally tubular fine filter 20 is arranged in the center portion of filter element 16.

A spray arm support 18 projects upwardly from the sump member 12. Spray arm support 18 comprises a hub 108 for a rotatable spray arm and a tubing section 110 which provides for a connection to an upper spray arm so as to provide cleaning liquid to the spray arms.

Figure 2:
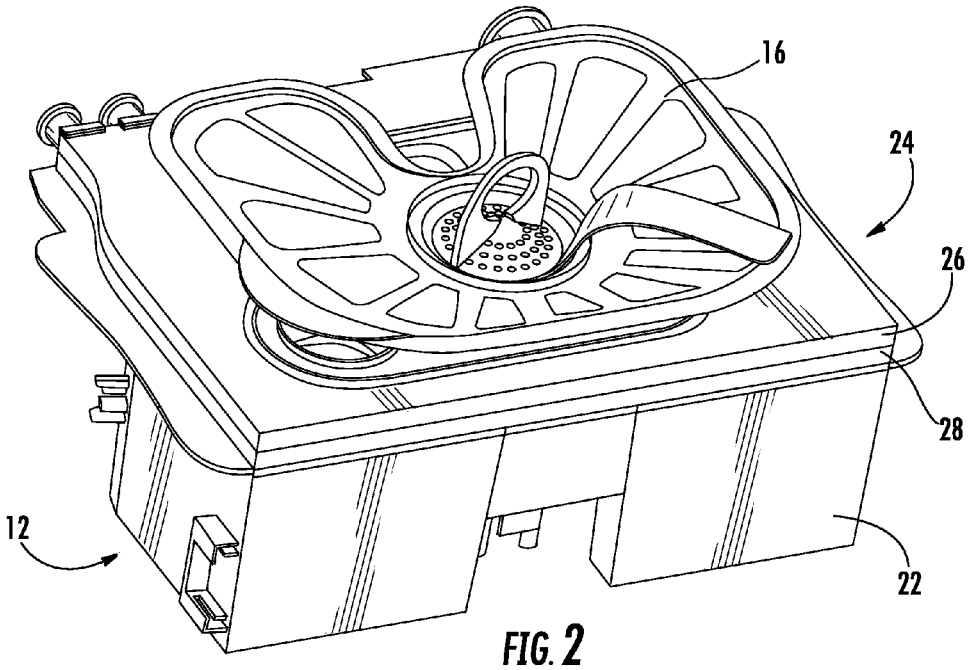
FIG. 2 is a perspective view of the sump member of FIG. 1, in which for purpose of illustration the tub bottom and the support for the lower spray arm has been removed.

FIG. 2 shows the sump member 12 of FIG. 1 in a slightly enlarged view and with the tub bottom 10 and the spray arm support 18 being removed. As can be seen in FIG. 2, sump member 12 comprises a lower part 22 and an upper part, which generally is designated with 24. Whereas lower part 22 of sump member 12 comprises several vessel sections for collecting or retaining liquid volumes, as will be further explained below by reference to FIGS. 5 and 6, upper part 24 of sump member 12 is a generally flat member, which constitutes a cover member for lower part 22 of the sump member. Sump member upper part 24, which also is designated herein as "cover member", comprises a generally flat sandwich-type structure comprising an upper sandwich component 26 and a lower sandwich component 28. Upper sandwich component 26 and lower sandwich component 28 enclose an intermediate space therebetween within which a plurality of integral passages is formed as will be explained below particularly by reference to FIG. 4.

Figure 3:
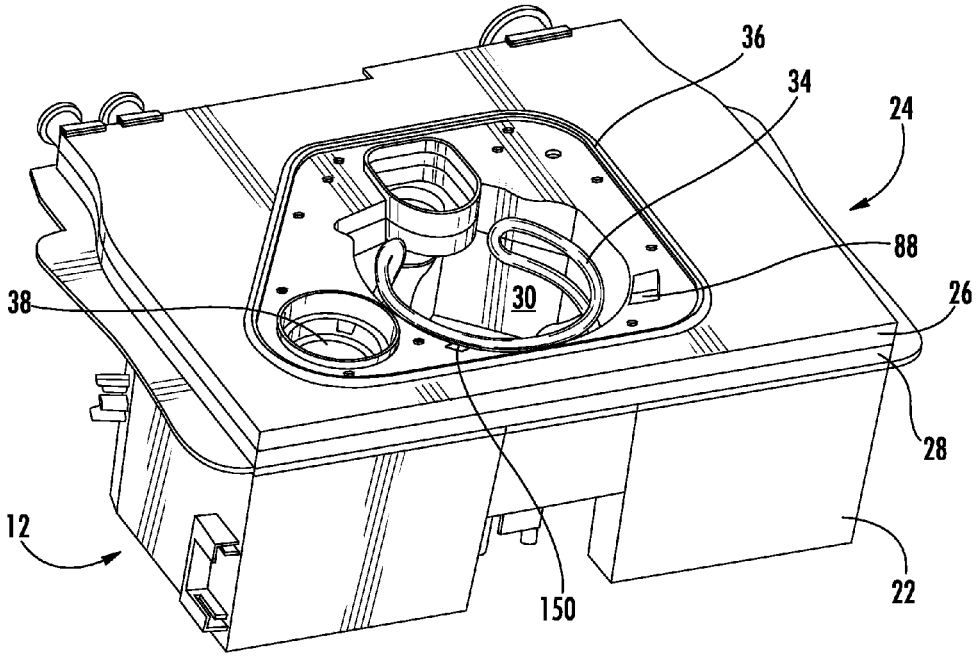
FIG. 3 is a perspective view of the sump member of FIG. 2, in which for purpose of illustration the filter elements that are shown in FIG. 2 were removed.

FIG. 3 is a view similar to FIG. 2, wherein, however, flat filter 16 and fine filter 20 are not shown, so as to provide a free view onto the upper sandwich component 26 of the upper part 24 of sump member 12. In the central portion of upper part 24 there is provided an opening 30, which provides for an access to a water collecting receptacle 32 (see FIGS. 4, 6 and 7) provided in the lower part 22 of sump member 12. Within the water collecting receptacle 32 in which in the assembled state of the dishwasher there is provided fine filter 20, there further is provided an electric heating element 34, which comprises a plurality of heating coils, which are provided in an annular configuration, so as to surround fine filter 20. On the upper side of upper sandwich component 26 there is provided a reception groove 36 for a sealing element, which in the assembled state of the dishwasher rests against the underside of tub bottom 10, so as to provide for a fluid-tight sealing between tub bottom 10 and sump member 12, so that water which collects in the tub bottom and flows through the opening 14 in tub bottom 10, is prevented from leaking outwardly, but rather is directed to the water collecting receptacle 32.

In the upper portion 24 of the sump member there further is provided a salt fill opening 38, which communicates with a salt tank 56 provided in the lower portion 22 of sump member 12, as will be explained in further detail below by reference to FIGS. 6 and 7. Along its inner circumference, salt fill opening 38 is provided with engagement means, such as threads or recesses for fixing a removable cap within salt fill opening 38, which cap thus can be screwed into salt fill opening 38 or is held therein by means of a bayonet connection.

Figure 4:
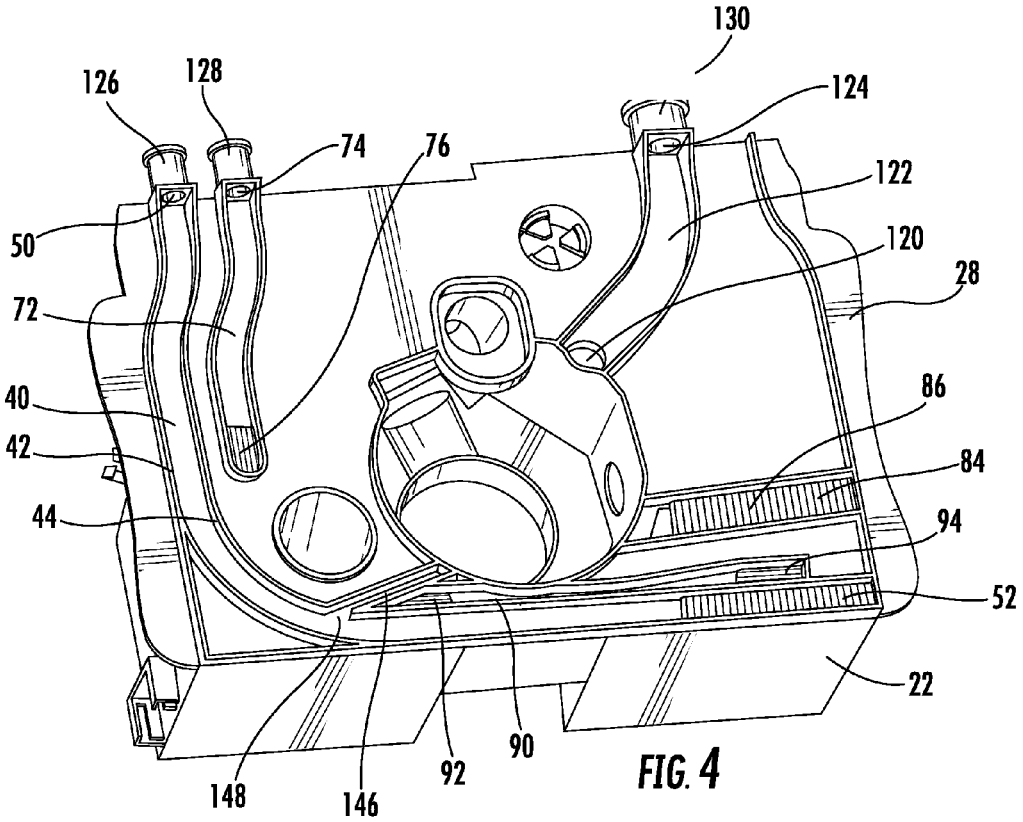
FIG. 4 is a perspective view of the sump member of FIG. 3, in which for purpose of illustration the upper portion of the sandwich-type cover member has been removed.
Figure 5:
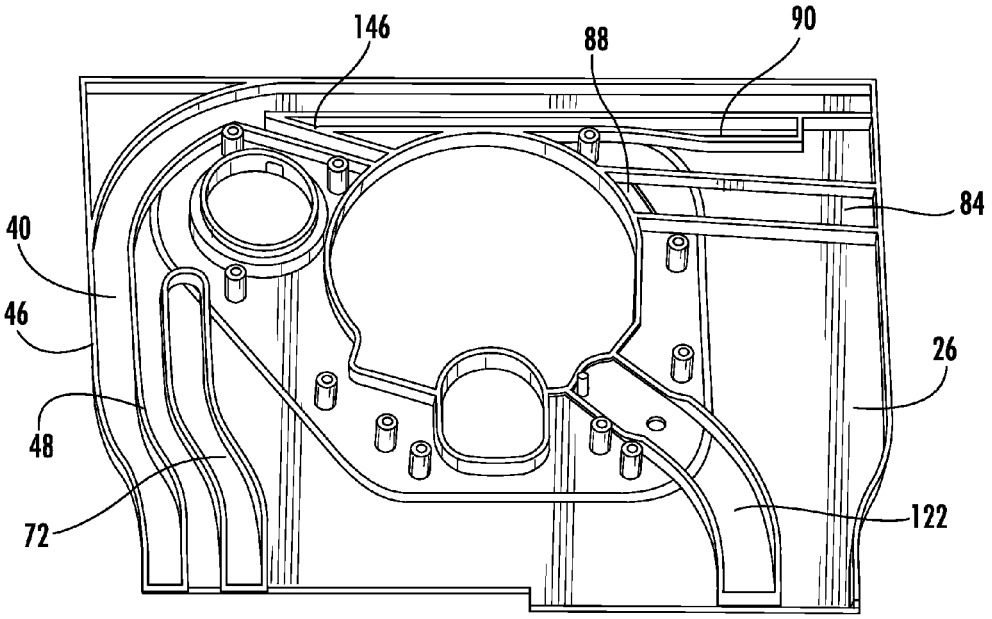
FIG. 5 is a perspective view of the upper portion of the sandwich-type cover member when viewed from below.
Figure 6:
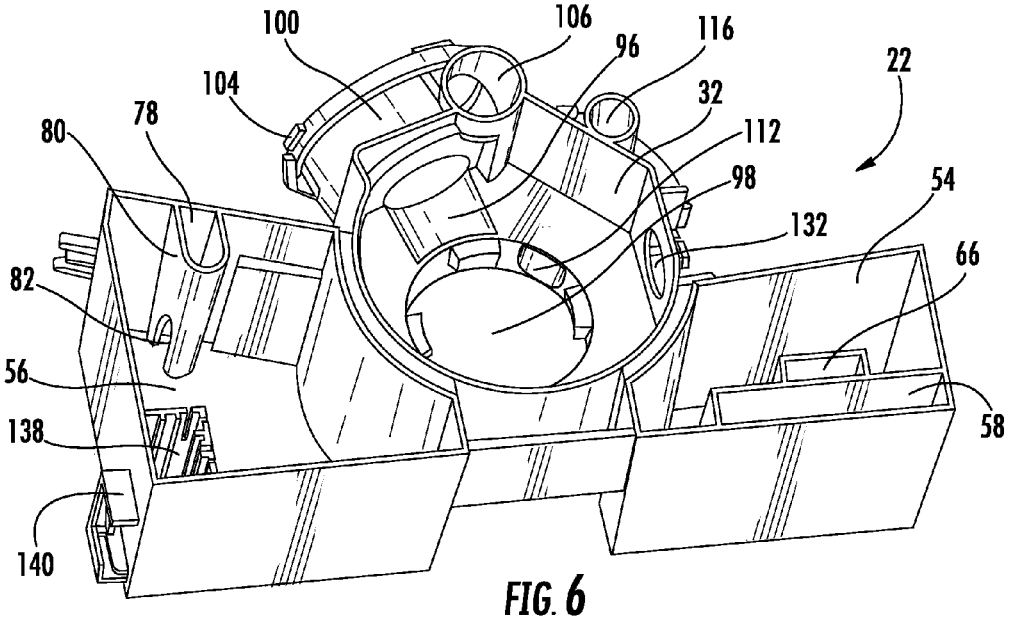
FIG. 6 is a perspective view of the lower portion of the sump member.
Figure 7:
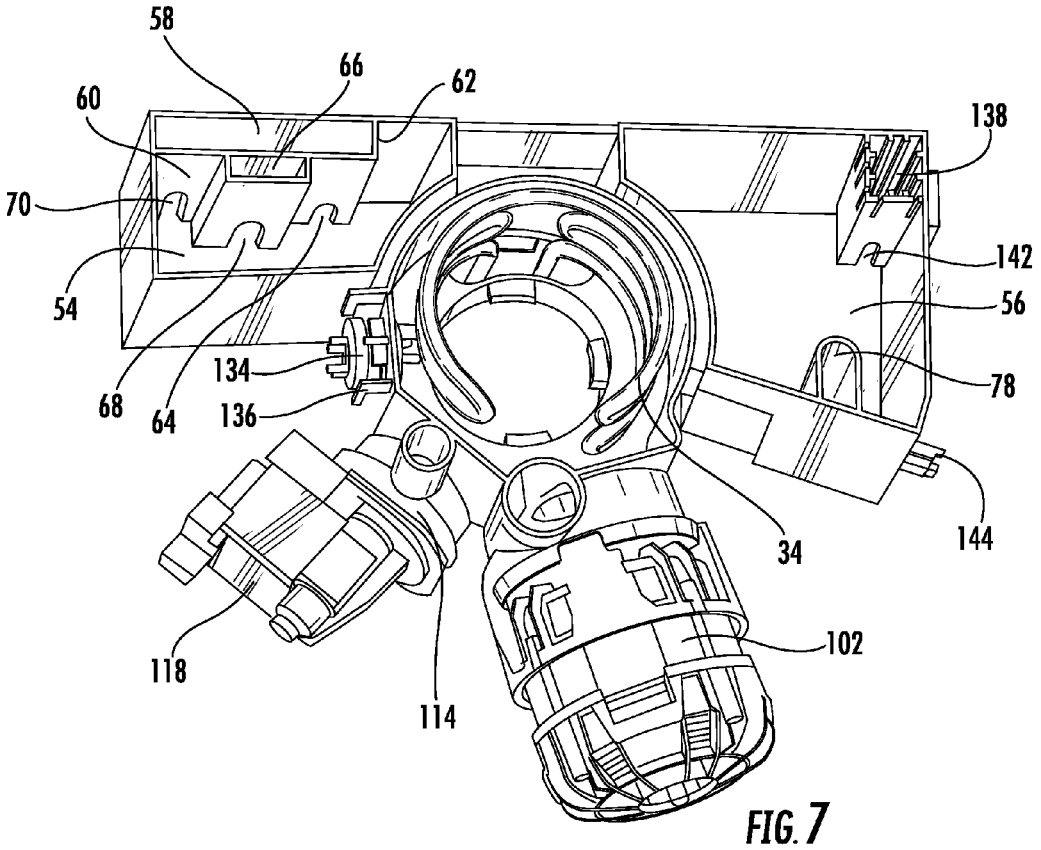
FIG. 7 is a further perspective view of the lower portion of the sump member from a different point of view and additionally illustrates further components of the dishwasher when mounted to the lower portion of the sump member.

Sump member 12 provides for various connections between hydraulic parts of the dishwasher, as will be explained by reference to FIGS. 4 to 7, wherein FIG. 4 is a perspective view of sump member 12, wherein upper sandwich component 26 of the upper part 24 of sump member 12 has been removed, so as to give a clear view onto the upper side of lower sandwich component 28, FIG. 5 is a perspective view of the upper sandwich component 28 when viewed from below, and FIGS. 6 and 7 illustrate the lower part 22 of the sump member 12 from different viewpoints.

A plurality of passages is formed in the intermediate space between the upper side of lower sandwich component 28 and the lower side of upper sandwich component 26. Thus, a first passageway 40 is formed between a first and a second vertical wall 42 and 44 of lower sandwich component 28 and corresponding first and second walls 46 and 48 provided at the lower side of upper sandwich component 26. When upper sandwich component 26 is placed onto lower sandwich component 28, the first vertical wall 46 of upper sandwich component 26 will rest on first vertical wall 42 of lower sandwich component 28. Correspondingly, second vertical wall 48 of lower sandwich component 26 will rest on second vertical wall 44 of lower sandwich component 28. In order to provide for a fluid-tight connection between upper and lower sandwich components 28 and 26, these components can be combined by gluing, welding or the like. In the assembled state, passageway 40 thus is a curved closed channel that is confined by an outer vertical wall formed by vertical walls 42, 46, an inner vertical wall formed by vertical walls 44, 48 a bottom wall that is provided by the upper side of lower sandwich component 28 as well as a top wall that is provided by the lower side of upper sandwich component 26. All the other passages, by which hydraulic components of the dishwasher are connected, as will be explained in further detail below, are formed in a similar manner. First passageway 40 extends from a water inlet 50 to an opening 52 within lower sandwich component 28 through which water flowing through first passageway 40 can pass through lower sandwich component 28 into a section of lower part 22 of sump member 12.

As is illustrated particularly in FIGS. 6 and 7, lower part 22 of sump member 12 comprises several vessel sections, namely a water collecting receptacle 32, an ion exchange material tank 54 and a salt tank 56. Within the ion exchange material tank 54 an essentially vertically oriented channel 58 is formed by means of vertical side walls 60 and 62. When sump member 12 is assembled, vertical channel 58 is located below opening 52 in lower sandwich member 28, so as to communicate with first passageway 40. At its lower end, vertical channel 58 opens into the ion exchange material tank 54 by means of openings 64 and 70, which are provided in vertical side wall 60. First passageway 40, opening 52, vertical channel 58 and openings 64 and 70 thus constitute a conduit (herein also referred to as "$1^{st}$ passage") for passing water from water inlet 50 into ion exchange material tank 54.

Referring again to FIGS. 4 and 5, further vertical walls are provided at the upper side of lower sandwich member 28 and at the lower side of upper sandwich component 26, so as to form a second passageway 72, which extends from a water inlet 74 to an opening 76 provided in lower sandwich component 28. Opening 76 communicates with a vertical channel 78, which is formed by a vertical wall member 80, which is provided within salt tank 56. Vertical channel 78 opens into salt tank 56 via an opening 82, which is provided in wall member 80. Second passageway 72, opening 76, vertical channel 78 and opening 82 thus constitute a conduit (herein also referred to as "$2^{nd}$ passage") for passing water from water inlet 74 into salt tank 56.

A third passageway 84 is provided within sump member upper part 24, which third passageway 84 extends from an opening 86 within lower sandwich component 28, which opening 86 is located above ion exchange material tank 54, to an outlet opening 88, which is provided in the upper sandwich component 26 (see FIGS. 3 and 5). Opening 86, passageway 84 and outlet opening 88 thus constitute a conduit (herein also referred to as "$3^{rd}$ passage") for passing water from ion exchange material tank 54 the washing chamber or into the water collecting receptacle 30 of the sump.

During operation of the dishwasher, water thus can be fed via inlet opening 50 and through the $1^{st}$ passage 40 into the ion exchange material tank so as to be softened therein by action of an ion exchange material, such as a softener resin, from which the softened water will be flowed out via opening 86 into third passage 84, from which the softened water exits via the $3^{rd}$ passage, so as to flow into the washing chamber or into the water collecting receptacle 30 of the sump, from which the softened water can be passed via a circulation pump to spray arms located within the dishwasher.

In order to regenerate the ion exchange material within tank 54 a salt solution can be passed through the ion exchange material tank 54, which salt solution is prepared within salt tank 56. To this end, a fourth passageway 90 is provided in the upper part 24 of sump member 12 by further vertical walls provided at the upper end lower sandwich component 26, 28. Fourth passage 90 comprises an inlet opening 92 through which salt solution from salt container 56 can flow into the fourth passageway 90, as well as an outlet opening 94, which connects to a vertical channel 66 provided within ion exchange material tank 54 and which opens via an opening 68 into the bottom of ion exchange material tank 54. Opening 92 of salt tank 54, fourth passageway 90, outlet opening 94, vertical channel 66 and opening 68 thus constitute a conduit (herein also referred to as "$4^{th}$ passage") for passing water from salt tank 56 into ion exchange material tank 54. Thus, if the ion exchange material within tank 54 is to be regenerated, water is passed via water inlet 74 and the $2^{nd}$ passage into salt tank 56 so as to form a salt solution. By passing additional water into salt tank 56 the already prepared salt solution is displaced from salt tank 56 and is passed via the $4^{th}$ passage into ion exchange material tank 54.

As is shown in FIGS. 4 and 5, a ninth passageway 146 is provided in the upper part 24 of sump member 12. Ninth passageway 146 branches off from a side-opening 148 of first passageway 40 and extends to an opening 150 provided in upper sandwich component 26 of sump member upper part 24. By means of the ninth passageway 146 a portion of the water that is passed from water inlet 50 to the water softening device, i.e. to ion exchange material tank 54, is fed directly into the sump and thus bypasses the ion exchange material tank 54. In order to adjust the amounts of water that is passed to the ion exchange material tank and is fed directly into the sump of the dishwasher, valve means can be provided preferably at point 148, where the ninth passageway 146 branches off from first passageway 40.

As shown in FIG. 6, a fifth passageway 96 is provided in the lower part 22 of sump member 12, which passageway has an opening close to the bottom 98 of water collecting receptacle 32 and extends to a first annular housing section 100. First annular housing section 100 is adapted to accommodate the impeller of a circulation pump 102 (shown in FIG. 7) which can be attached to housing section 100 by means of fixations 104 which engage respective projections provided at circulation pump 102. Lower part 22 of sump member 12 further comprises a sixth passageway 106 which comprises an outlet of annular housing section 100 through which water, which by action of the impeller of circulation pump 100 is withdrawn from bottom 98 of water collecting receptacle 32, is passed via an opening 107 in both the lower sandwich component 28 and upper sandwich component 26 of sump member upper part 24 to a water distribution system which feeds the spray arms that are located within the wash chamber. In this manner, circulation pump 102 feeds circulation water to spray arm support 18 shown in FIG. 1, from which water is passed to via tubing section 108 to a lower spray arm and water is passed via tubing section 110 to an upper spray arm.

While fifth passageway 96 and its respective openings into water collecting receptacle 32 and annular housing section 100 thus constitute a conduit (herein also referred to as "$5^{th}$ passage") for passing water from the sump member to the circulation pump 102, outlet 106 of annular housing section 100, opening 107 and tubing sections 108 and 110 of spray arm support 18 constitute a conduit (herein also referred to as "$6^{th}$ passage") for passing water from the circulation pump 102 to the spraying nozzles.

A lower part 22 of sump member 12 furthermore comprises a seventh passageway 112, which opens close to the bottom 98 of water collecting receptacle 32. Seventh passageway 112 leads into a second annular housing section 114, which is adapted to accommodate the impeller of a drain pump 118, which is mounted to sump member lower part 22 by means of respective fixations provided at second annular housing section 114. Second annular housing section 114 in an upper section thereof comprises an outlet 116, through which water that is withdrawn by the action of drain pump 118 from the bottom of water collecting receptacle 32 is passed upwards to an opening 120 provided in lower sandwich component 28 of sump member upper part 24. As shown in FIG. 4, opening 120 opens into an eighth passageway 122, which is provided by corresponding vertical wall sections provided on the upper side of lower sandwich component 28 and on the lower side of upper sandwich component 26. Eighth passageway 122 leads to an outlet opening 124.

While seventh passageway 112 and its respective openings into water collecting receptacle 32 and annular housing section 114 thus constitute a conduit (herein also referred to as "$7^{th}$ passage") for passing water from the sump member to the drain pump 118, outlet 116 of annular housing section 114, opening 120 and eighth passageway 122 constitute a conduit (herein also referred to as "$8^{th}$ passage") for passing waste water from the drain pump 118 to a drain tube of the dishwasher.

In order to connect sump member 12 to respective water inlet and water outlet lines of the dishwasher, such as a mains inlet tube for feeding fresh tap water into the dishwasher, or a drain tube for passing waste water to a domestic drain, sump member 12 preferably is provided with respective flange portions. In particular, as is shown in FIG. 4, sump member upper part 24 can be provided with flange elements 126, 128 and 130, which in the embodiment shown in FIG. 4 can be provided as an integral part of lower sandwich component 28 but which alternatively could also be provided at upper sandwich component 26, wherein flange element 126 communicates with water inlet opening 50 of first passageway 40, flange element 128 communicates with water inlet opening 74 of second passageway 72 and flange element 130 communicates with outlet opening 124 of eighth passageway 122.

As is shown in FIGS. 6 and 7, sump member 12 can be provided with further fixations, where additional hydraulic, electric or electronic components of the dishwasher can be attached. Thus, as is shown in FIGS. 6 and 7, sump member lower part 22 can comprise an opening 132, which is provided in a wall of water collecting receptacle 32, at which opening 132 a turbidity sensor 134 is mounted. Turbidity sensor 134 is held at lower part 22 of sump member 12 by means of fixation elements 136 which are integrally formed at the exterior side of the wall of water collecting receptacle 32. By means of turbidity sensor 134 the water quality within the sump can be measured, so as to adapt the washing cycle carried-out in the dishwasher.

As is shown in FIG. 6, lower part 22 of sump member 12 further comprises a housing section 138 adjacent salt tank 56, which housing section 138 is adapted to accommodate a float of a reed switch, which can be attached to sump member lower part 22 at a fixation 140 provided on the exterior side of sump member lower part 22. Housing section 138, in a lower section thereof, comprises an opening 124 towards salt tank 56, so that the liquid level within housing section 138 at all times will correspond to the liquid level within salt tank 56. In this manner a reed switch that is attached to fixation 140 can measure the filling level within salt tank 56 by detecting the position of the reed float floating on the liquid within housing section 138.

Sump member 12 further can be provided with further integral fixations such as fixation 144 shown in FIG. 7, which may be used either for attaching further components to the sump member or for mounting the sump member itself within the dishwasher.

The dishwasher suggested herein which comprises a sump member having a plurality of integrated passages for connecting various hydraulic components of the dishwasher is advantageous over prior art devices in that it provides for a compact design which comprises less parts and particularly less tubings and fittings and which further can be assembled in modular, pre-assembled units. Furthermore, by the use of integrated passages, less pressure loss occurs within the connections of the various hydraulic components of the dishwasher, which leads to a lower water consumption during operation of the dishwasher. The concept suggested herein thus not only provides for higher product safety but also results in lower manufacturing costs and, due to the reduced water consumption, lower operating costs.

| List of parts | |
|---|---|
| 10 | tub bottom |
| 12 | sump member |
| 14 | opening |
| 16 | flat filter |
| 18 | sprayarm support |
| 20 | fine filter |
| 22 | sump member lower part |
| 24 | sump member upper part |
| 26 | upper sandwich component |
| 28 | lower sandwich component |
| 30 | opening to 32 |
| 32 | water collecting receptacle |
| 34 | heating element |
| 36 | reception groove |
| 38 | salt fill opening |
| 40 | $1^{st}$ passageway |
| 42 | vertical wall at 28 |
| 44 | vertical wall at 28 |
| 46 | vertical wall at 26 |
| 48 | vertical wall at 26 |
| 50 | water inlet of 40 |

-continued

| List of parts | |
|---|---|
| 52 | outlet opening of 40 |
| 54 | ion exchange material tank |
| 56 | salt tank |
| 58 | vertical passage |
| 60, 62 | vertical side walls |
| 64 | outlet opening |
| 66 | vertical channel |
| 68 | outlet opening |
| 70 | outlet opening |
| 72 | $2^{nd}$ passageway |
| 74 | water inlet |
| 76 | opening of 72 |
| 78 | vertical channel |
| 80 | wall member |
| 82 | opening in 80 |
| 84 | $3^{rd}$ passageway |
| 86 | outlet opening of 54 |
| 88 | outlet opening of 84 |
| 90 | $4^{th}$ passageway |
| 92 | inlet opening of 90 |
| 94 | outlet opening of 90 |
| 96 | $5^{th}$ passageway |
| 98 | bottom of 30 |
| 100 | $1^{st}$ annular housing section |
| 102 | circulation pump |
| 104 | fixing |
| 106 | $6^{th}$ passageway |
| 107 | opening in 24 |
| 108 | outlet to upper sprayarm |
| 110 | outlet to lower sprayarm |
| 112 | $7^{th}$ passageway |
| 114 | $2^{nd}$ annular housing section |
| 116 | outlet of 114 |
| 118 | drain pump |
| 120 | opening to 122 |
| 122 | $8^{th}$ passageway |
| 124 | outlet opening 124 |
| 126 | flange element of 40 |
| 128 | flange element of 72 |
| 130 | flange element of 122 |
| 132 | opening for 134 |
| 134 | turbidity sensor |
| 136 | fixation for 134 |
| 138 | reed float housing |
| 140 | reed switch |
| 142 | opening in 138 |
| 144 | fixation |
| 146 | $9^{th}$ passageway |
| 148 | branch-off from 40 |

The invention claimed is:

1. A dishwasher comprising a wash chamber and a water-collecting sump member which is disposed below the wash chamber and fastened to an opening in a lower end portion of the wash chamber by means of a water-tight connection, wherein the sump member is made at least in part of plastics material and comprises at least one water inlet or outlet opening that is formed as an integral part of the sump member, wherein the dishwasher comprises a water softening device and the sump member comprises a water inlet configured to directly engage a mains fresh water inlet tube and an integrated first passage including the water inlet that is formed at least in part of plastics material as an integrally formed part of the sump member for passing water from the water inlet to the water softening device, wherein the sump member further comprises a lower part comprising at least a water collecting receptacle and an upper part comprising at least the integrated first passage and a water collecting opening, wherein the lower part is attached to and disposed directly below the upper part, wherein the upper part is attached to the opening in the lower end portion of the wash chamber and the lower part is attached to a bottom part of the upper part, such that the lower part is only attached to the lower end portion of the wash chamber via the upper part, and wherein at least part of the upper part, including part of the integrated first passage and part of the water collecting opening, defines a single molded piece of the plastics material.

2. The dishwasher of claim 1, wherein the sump member forms at least part of a housing of a pump of the dishwasher.

3. The dishwasher of claim 1, wherein the sump member further comprises at least one fixation element for attaching further components, such as electronic or electromechanical devices, to the sump member.

4. The dishwasher of claim 1, wherein the sump member is made of moldable plastics material which is resistant to alkaline and hot water, and preferably is made of polypropylene.

5. The dishwasher of claim 1, wherein the integrated first passage defines a first end configured to pass water from the water inlet to the integrated first passage and a second end configured to pass water from the integrated first passage to the water softening device, wherein the integrated first passage is substantially horizontal, such that an axis spanning the first end of the integrated first passage and the second end of the integrated first passage is substantially parallel to the lower end portion of the wash chamber.

6. The dishwasher of claim 1, wherein the water softening device comprises an ion exchange material tank for accommodating an ion exchange material.

7. The dishwasher of claim 6, wherein the water softening device comprises a salt tank for storing a salt solution for the regeneration of said ion exchange material and the sump member comprises an integrated second passage that receives water from the mains fresh water inlet tube and leads it into the salt tank.

8. The dishwasher of any one of claim 7, wherein the sump member comprises an integrated third passage for passing water from the ion exchange material tank into the wash chamber or into a water collecting space of the sump member.

9. The dishwasher of claim 8, wherein the sump member comprises an integrated fourth passage for passing salt solution from the salt tank into the ion exchange material tank.

10. The dishwasher of claim 9, wherein the sump member comprises an integrated fifth passage for passing water from the sump member to a circulation pump of the dishwasher.

11. The dishwasher of claim 10, wherein the sump member comprises an integrated sixth passage for passing water from the circulation pump to spraying nozzles which provide water within the wash chamber.

12. The dishwasher of claim 11, wherein the sump member comprises an integrated seventh passage for passing waste water from the sump member to a drain pump of the dishwasher.

13. The dishwasher of claim 12, wherein the sump member comprises an integrated eighth passage for passing waste water from the drain pump to a drain tube of the dishwasher.

14. The dishwasher of claim 13, wherein the sump member comprises an integrated ninth passage which branches off from the first passage upstream of the water softening device for passing at least a portion of the water passing through the first passage into the wash chamber or into the water collecting space of the sump member.

15. The dishwasher of claim 7, wherein at least one of the ion exchange material tank or the salt tank is formed at least in part of plastics material as an integrally formed part of the sump member.

16. The dishwasher of claim 7, wherein the lower part of the sump member further comprises said at least one of the ion exchange material tank or said salt tank, and wherein the upper part of the sump member further forms a cover member for at least a portion of said water-collecting receptacle, said at least one of the ion exchange material tank or said salt tank.

17. The dishwasher of claim 16, wherein the lower part and the upper portion of the sump member are formed at least in part of plastics material, wherein at least one of said first and second passage comprise an integrally formed part of at least one of the lower or upper part of the sump member.

18. The dishwasher of claim 7, wherein the salt tank comprises a salt fill opening which is located below said opening in the lower end portion of the wash chamber.

19. The dishwasher of claim 18, wherein a filter sieve is arranged within the opening in the lower end portion of the wash chamber, and wherein the salt fill opening is located below said filter sieve.

* * * * *